US005558551A

United States Patent [19]

Irby

[11] Patent Number: 5,558,551

[45] Date of Patent: Sep. 24, 1996

[54] STEERABLE SWIMMER TOWING DEVICE

[76] Inventor: David W. Irby, 10750 SW. Fox Brown Rd., Indian Town, Fla. 34956

[21] Appl. No.: 528,992

[22] Filed: Sep. 15, 1995

[51] Int. Cl.[6] ..... B63B 35/79

[52] U.S. Cl. ..... 441/65; 114/253; 441/79

[58] Field of Search ..... 441/65, 79; 114/245, 114/253

[56] References Cited

U.S. PATENT DOCUMENTS 3,107,640 10/1963 Lepine et al. ..... 114/245
3,145,400 8/1964 Yoakum ..... 441/65
3,261,318 7/1966 Jones et al. ..... 114/245
3,395,411 8/1968 Pope, Jr. et al. ..... 441/79
3,625,172 12/1971 Gilster ..... 114/245

*Primary Examiner*—Sherman Basinger

[57] ABSTRACT

A device for towing a swimmer behind a boat. The inventive device includes a planar member having a line anchor coupled thereto for securing to a tow line extending behind a boat. Handle apertures are directed through the planar member for engaging hands of a swimmer and a steering fin extends from a bottom surface of the planar member such that the swimmer can articulate the planar member to steer and dive within the water while being towed behind the boat.

1 Claim, 3 Drawing Sheets

FIG 1
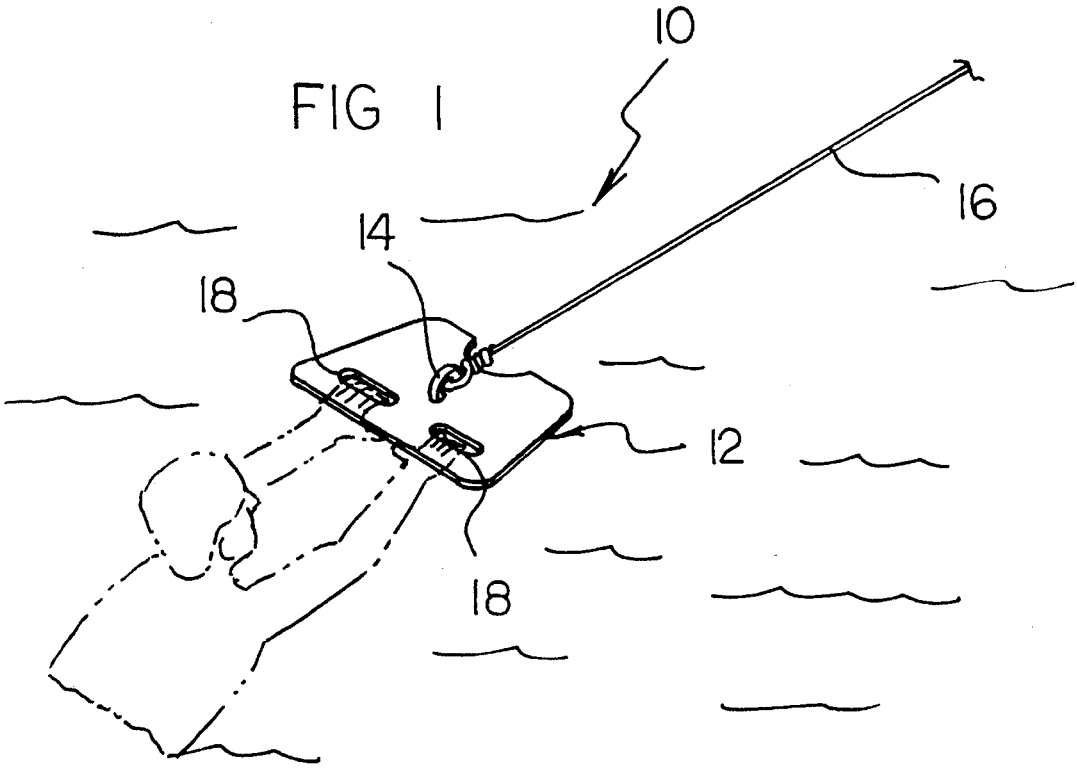
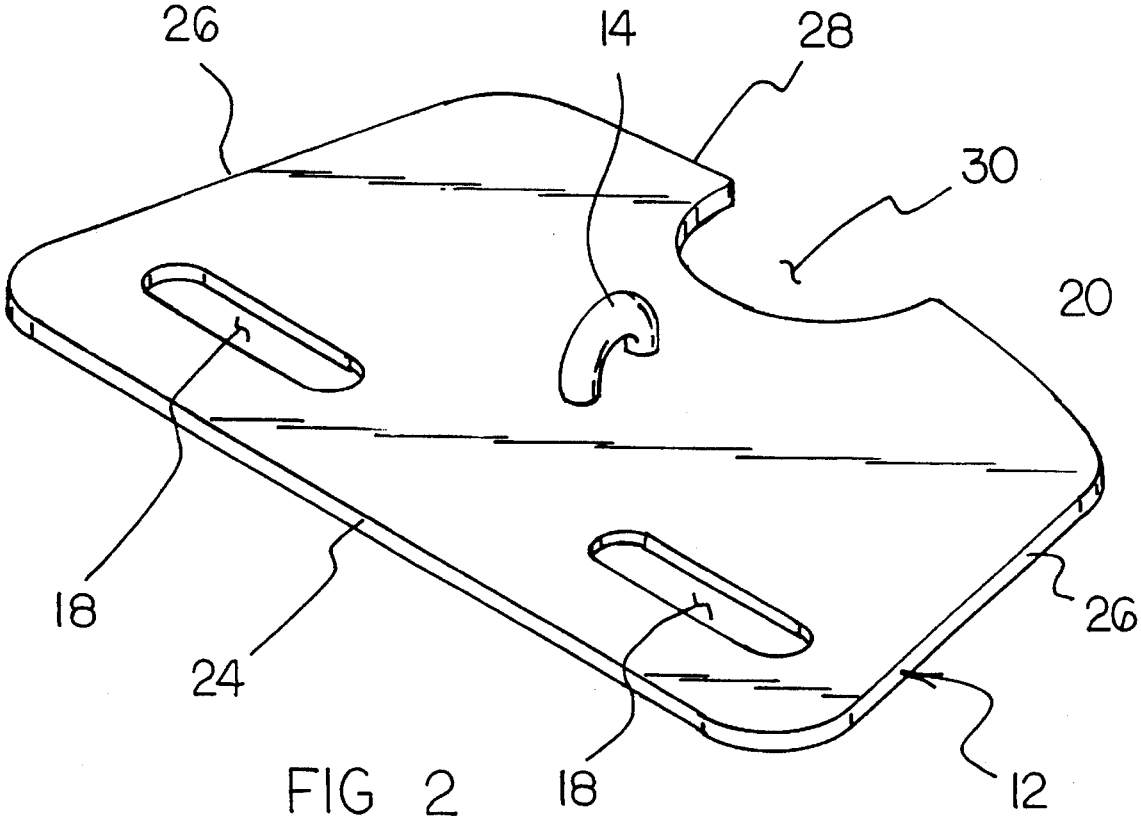
FIG 2

STEERABLE SWIMMER TOWING DEVICE

BACKGROUND OF THE INVENTION

1. Field of the Invention

The present invention relates to towable fluid reaction structures and more particularly pertains to a steerable swimmer towing device for towing a swimmer behind a boat.

2. Description of the Prior Art

The use of towable fluid reaction structures is known in the prior art. More specifically, towable fluid reaction structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art towable fluid reaction structures include U.S. Pat. No. 5,122,085; U.S. Pat. No. 5,257,953; U.S. Pat. No. 5,242,322; U.S. Pat. No. 5,334,066; U.S. Design Pat. No. 315,771; and U.S. Design Pat. No. 265,898.

While these devices fulfill their respective, particular objectives and requirements, the aforementioned patents do not disclose a steerable swimmer towing device for towing a swimmer behind a boat which includes a planar member having a line anchor coupled thereto for securing to a tow line extending behind a beat, with handle apertures directed through the planar member and a steering fin extending from a bottom surface of the planar member such that a swimmer can articulate the planar member to steer and dive within the water when being towed behind a boat.

In these respects, the steerable swimmer towing device according to the present invention substantially departs from the conventional concepts and designs of the prior art, and in so doing provides an apparatus primarily developed for the purpose of towing a swimmer behind a boat.

SUMMARY OF THE INVENTION

In view of the foregoing disadvantages inherent in the known types of towable fluid reaction structures now present in the prior art, the present invention provides a new steerable swimmer towing device construction wherein the same can be utilized for towing a swimmer behind a boat. As such, the general purpose of the present invention, which will be described subsequently in greater detail, is to provide a new steerable swimmer towing device apparatus and method which has many of the advantages of the towable fluid reaction structures mentioned heretofore and many novel features that result in a steerable swimmer towing device which is not anticipated, rendered obvious, suggested, or even implied by any of the prior art towable fluid reaction structures, either alone or in any combination thereof.

To attain this, the present invention generally comprises a device for towing a swimmer behind a boat. The inventive device includes a planar member having a line anchor coupled thereto for securing to a tow line extending behind a boat. Handle apertures are directed through the planar member for engaging hands of a swimmer and a steering fin extends from a bottom surface of the planar member such that the swimmer can articulate the planar member to steer and dive within the water while being towed behind the boat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the an who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new steerable swimmer towing device apparatus and method which has many of the advantages of the towable fluid reaction structures mentioned heretofore and many novel features that result in a steerable swimmer towing device which is not anticipated, rendered obvious, suggested, or even implied by any of the prior art tool guides, either alone or in any combination thereof.

It is another object of the present invention to provide a new steerable swimmer towing device which may be easily and efficiently manufactured and marketed.

It is a further object of the present invention to provide a new steerable swimmer towing device which is of a durable and reliable construction.

An even further object of the present invention is to provide a new steerable swimmer towing device which is susceptible of a low cost of manufacture with regard to both materials and labor, and which accordingly is then susceptible of low prices of sale to the consuming public, thereby making such steerable swimmer towing devices economically available to the buying public.

Still yet another object of the present invention is to provide a new steerable swimmer towing device which provides in the apparatuses and methods of the prior art some of the advantages thereof, while simultaneously overcoming some of the disadvantages normally associated therewith.

Still another object of the present invention is to provide a new steerable swimmer towing device for towing a swimmer behind a boat.

Yet another object of the present invention is to provide a new steerable swimmer towing device which includes a planar member having a line anchor coupled thereto for securing to a tow line extending behind a boat, with handle apertures directed through the planar member and a steering fin extending from a bottom surface of the planar member such that a swimmer can articulate the planar member to steer and dive within the water when being towed behind a boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a steerable swimmer towing device according to the present invention in use.

FIG. 2 is an isometric illustration of the invention, per se.

DESCRIPTION OF THE PREFERRED EMBODIMENT

Figure 3:
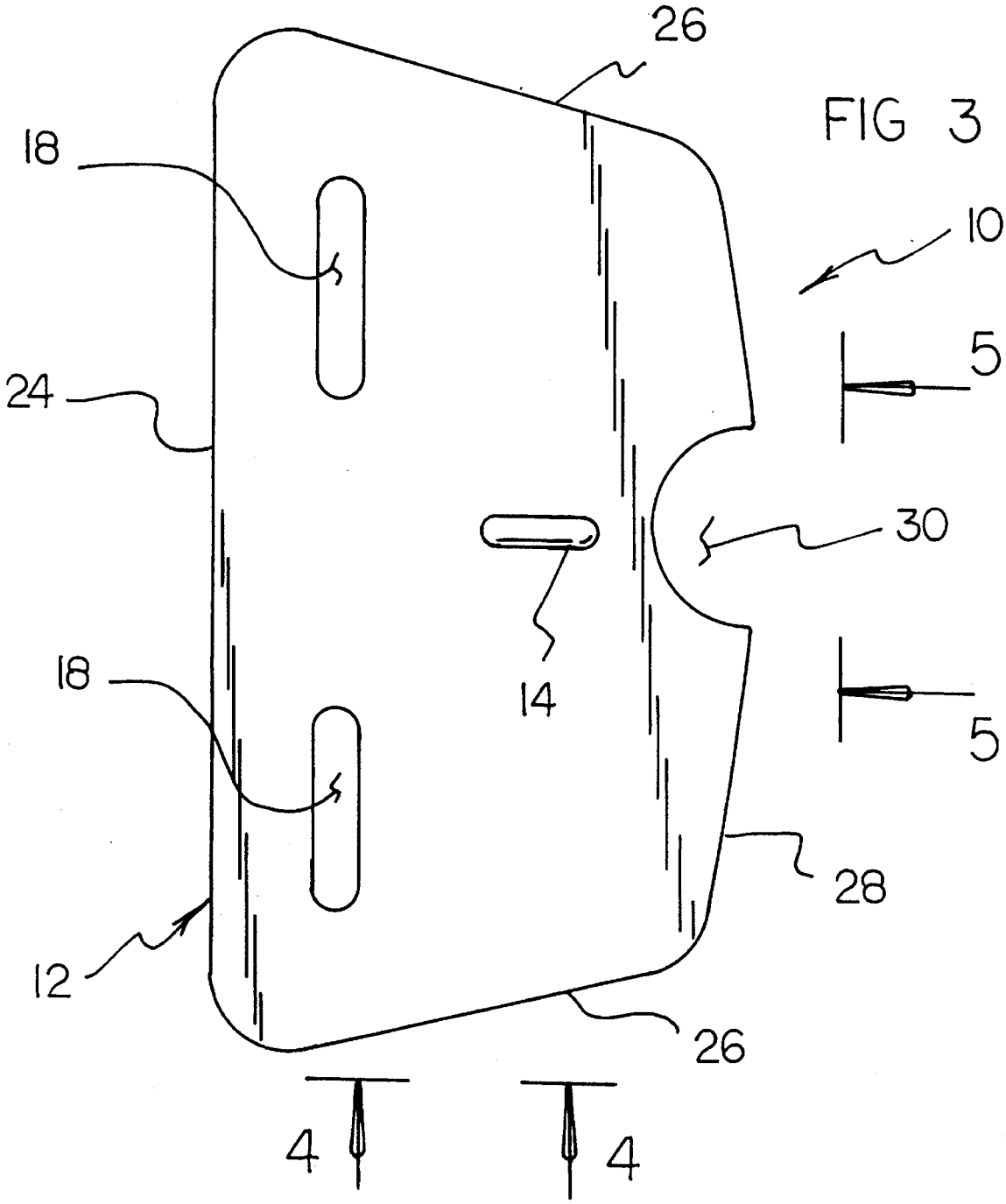
FIG. 3 is a top plan view thereof.

With reference now to the drawings, and in particular to FIGS. 1–6 thereof, a new steerable swimmer towing device embodying the principles and concepts of the present invention and generally designated by the reference numeral 10 will be described.

More specifically, it will be noted that the steerable swimmer towing device 10 comprises a planar member 12 having a line anchor 14 coupled thereto for permitting securement of a tow line 16 extending from an unillustrated boat to the planar member 12. The planar member 12 is shaped so as to define a plurality of handle apertures 18 directed thereto which permit an individual to grasp the planar member 12. By this structure, an individual can grasp the planar member 12 to be towed behind an associated boat by the tow line 16 as desired.

Figure 4:
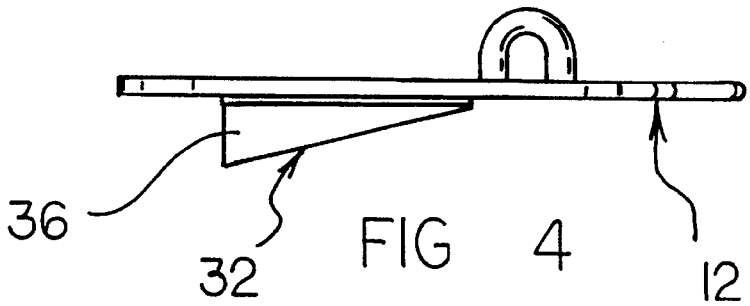
FIG. 4 is a side elevation view taken from line 4—4 of FIG. 3.
Figure 5:
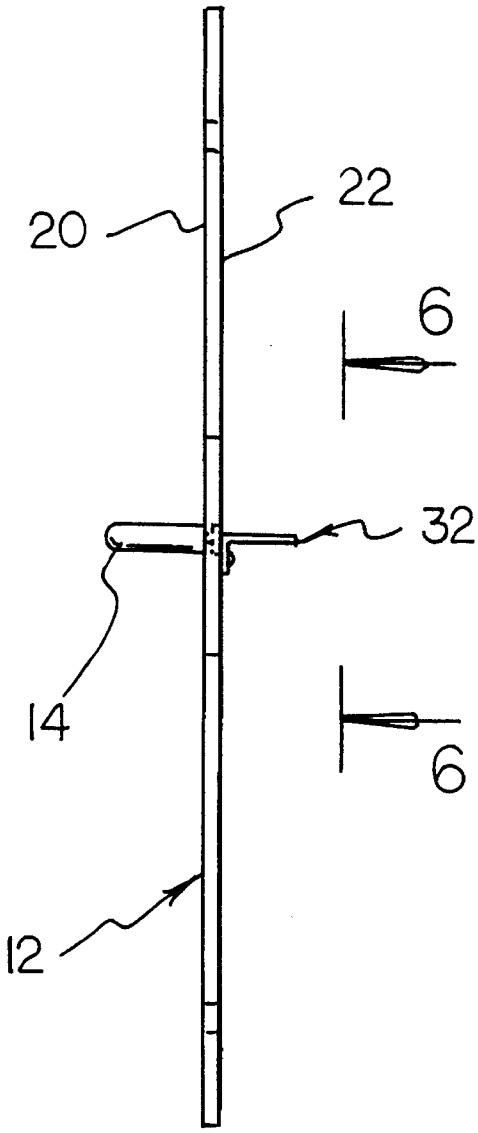
FIG. 5 is a front elevation view taken from line 5—5 of FIG. 3.
Figure 6:
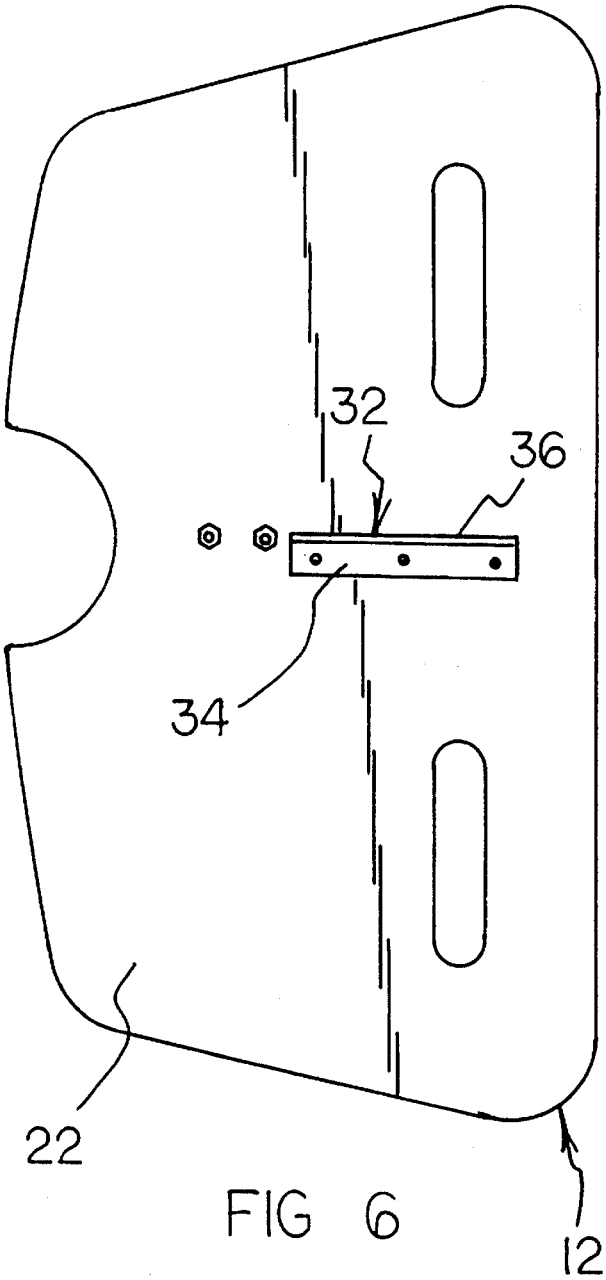
FIG. 6 is a bottom plan view of the present invention taken from line 6—6 of FIG. 5.

Referring know to FIGS. 2 through 6 wherein the present invention 10 is illustrated in detail, it can be shown that the planar member 12 of the present invention 10 is shaped so as to define a planar top surface 20 oriented in a substantially spaced and parallel orientation relative to a planar bottom surface 22, as shown in FIGS. 5 and 6 of the drawings. The line anchor 14 preferably extends from the planar top surface 20 and is also preferably centrally positioned relative to the planar member 12. The planar member 12 further includes a linear rear edge 24 having linear lateral edges 26 projecting from opposed ends of the linear rear edge. A forward edge 28 extends between the linear lateral edges 26 and is preferably substantially arcuate in shape. A line clearance aperture 30 is directed into the planar member 12 and interrupts the forward edge 28 so as to separate the forward edge into spaced portions. The line clearance aperture 30 projects towards the line anchor 14 and is centrally aligned between the linear lateral edges 26 to permit the tow line 16 when coupled to the line anchor 14 to project below the planar member 12. In other words, the line clearance aperture 30 allows the planar member 12 to be articulated about a horizontal axis directed through the line anchor 14 and oriented substantially orthogonally relative to the tow line 16 so as to permit an individual to ascend or descend with in a body of water as the device 10 is towed behind an associated boat. As shown in FIG. 2, the handle apertures 18 are preferably shaped as to define elongated slots directed through planar member 12 which are oriented in a substantially spaced and parallel orientation relative to the linear rear edge 24 thereof. By this structure, an individual can grasp the planar member 12 by extending digits of a human hand through the handle apertures 18, whereby articulation of the planar member 12 about the horizontal axis directed through the line anchor 14 and orthogonal to the tow line 16 can effect elevation of the device 10 and associated swimmer within a body of water as the device 10 is towed behind an associated boat.

As shown in FIG. 4, the present invention 10 may further comprise a steering fin 32 coupled to the bottom surface 22 of the planar member 12. To this end, the steering fin 32 preferably comprises a mounting plate 34 secured to the bottom surface 22 by unlabeled fasteners or the like directed through the mounting plate 34 and into the planar member 12. A vertical plate 36 is orthogonally coupled to the mounting plate 34 so as to project substantially orthogonally from the bottom surface 22 of the planar member 12. Preferably, tile vertical plate 36 is shaped so as to taper from a first vertical height proximal to a forward edge of tile mounting plate 34 to a second vertical height proximal to a rearward edge of tile mounting plate 34, wherein the second vertical height is substantially greater than the first vertical height substantially as shown in FIG. 4 of the drawings. By this structure, an articulation of the planar member 12 about a vertical axis directed through the line anchor 14 and oriented so as to extend substantially orthogonally relative to the top and bottom surfaces 20 and 22 of the planar member 12 will effect lateral steering of the device 10 within a body of water if the invention is towed behind an associated boat.

In use, the steerable swimmer towing device 10 according to the present invention can be easily utilized for towing a swimmer behind a boat. The specific mounting of the line anchor 14 and the overall configuration of the device 10 including the steering fin 32 permits an individual to control both lateral and vertical positioning of the device 10 within a body of water so as to permit for ease of photographing underwater structures or the like as desired by an individual.

As to a further discussion of the manner of usage and operation of the present invention, the same should be apparent from the above description. Accordingly, no further discussion relating to the manner of usage and operation will be provided.

With respect to tile above description then, it is to be realized that the optimum dimensional relationships for tile parts of tile invention, to include variations in size, materials, shape, form, function and manner of operation, assembly and use, are deemed readily apparent and obvious to one skilled in the art, and all equivalent relationships to those illustrated in tile drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A steerable swimmer towing device comprising:

a planar member having a line anchor coupled thereto for permitting securement of a tow line to the planar member, the planar member being shaped so as to define a plurality of handle apertures directed thereto such that an individual can grasp the planar member to be towed behind a boat by the tow line, the planar member being shaped so as to define a planar top surface oriented in a substantially spaced and parallel orientation relative to a planar bottom surface with the line anchor extending from the planar top surface. The line anchor being positioned centrally within the top surface of the planar member, the planar member being further shaped so as to define a linear rear edge having linear lateral edges projecting from opposed ends of the linear rear edge, and a forward edge extending between the linear lateral edges, the forward edge being substantially arcuate in shape and including a line clearance aperture directed inwardly of the forward edge so as to separate the forward edge into spaced portions thereof, the line clearance aperture projecting towards the line anchor and being centrally aligned between the linear lateral edges to permit a tow line when coupled to the line anchor to project below the planar member, the handle apertures being comprised of elongated slots directed through the planar member oriented in a substantially spaced and parallel orientation relative to the linear edge thereof, a steering fin coupled to the bottom surface of the planar member, the steering fin comprising a mounting plate secured to the bottom surface and a vertical plate coupled to the mounting plate and projecting substantially orthogonally from the bottom surface of the planar member, the vertical plate being shaped so as to taper from a first vertical height proximal to a forward edge of the mounting plate to a second vertical height proximal to a rearward edge of the mounting plate, wherein the second vertical height is substantially greater than the first vertical height.

* * * * *